United States Patent [19]

Inesso

[11] 4,372,005

[45] Feb. 8, 1983

[54] OPERATOR FOR SLIDING DOORS

[76] Inventor: Richard X. Inesso, 6420 Adelphia St., Pittsburgh, Pa. 15206

[21] Appl. No.: 175,178

[22] Filed: Aug. 4, 1980

[51] Int. Cl.[3] ..... E05F 3/10; E05F 17/00

[52] U.S. Cl. ..... 16/52; 16/58; 49/359

[58] Field of Search ..... 16/71, 72, 79, 80, 81, 16/DIG. 8, DIG.10, 52, 58, 66; 49/359, 363

[56] References Cited

U.S. PATENT DOCUMENTS

| | | | |
|---|---|---|---|
| 705,355 | 7/1902 | Johnson | 16/72 X |
| 851,272 | 4/1907 | Bell | 16/80 |
| 935,795 | 10/1909 | Krause | 49/359 |
| 1,272,160 | 7/1918 | Weiss | 49/359 |
| 3,161,908 | 12/1964 | Walach | 16/52 |
| 3,561,161 | 2/1971 | Green | 49/359 |

FOREIGN PATENT DOCUMENTS

| | | | |
|---|---|---|---|
| 379655 | 9/1932 | United Kingdom | 49/359 |
| 400755 | 11/1933 | United Kingdom | 16/72 |

*Primary Examiner*—W. Carter Reynolds
*Attorney, Agent, or Firm*—Robert D. Yeager; Andrew J. Cornelius

[57] ABSTRACT

A closure for a pair of sliding doors is provided that allows a user to open and automatically close both doors of a pair of sliding doors. The doors can be operated individually or simultaneously. The closure includes a pivoting link having two members, one fixed to each door, and a biasing device for pivoting the members and closing the doors.

7 Claims, 5 Drawing Figures

OPERATOR FOR SLIDING DOORS

BACKGROUND OF THE INVENTION

1. Field of the Invention

This invention relates to door closures and, more particularly, to apparatus for automatically closing either door of a pair of sliding doors.

2. Description of the Prior Art

To enjoy widespread use, an automatic closure for sliding doors must include several features. First, the closure must be sufficiently rugged to withstand wear due to use in commercial environments. Second, it must be simple in construction and easy to install so that persons who do not possess great skill with tools can install it themselves. Finally, where it is desirable to conceal the closure from view, for example where the sliding doors are used in residential closets, a user must be able to open and close the doors without manually manipulating the closure.

Sliding door closures using counterweights or electric motors enjoy only limited use because they are relatively expensive and difficult to install. Closures having systems of levers have long been used to manually or automatically close sliding elevator doors. Examples of such closures are disclosed in U.S. Pat. Nos. 1,204,913; 1,714,761; 1,203,413; 1,585,666; and 1,620,430. However, an objective of such closures is to lock the door in the closed position. Thus, the lever systems of such closures require that the longitudinal axes of the levers be aligned when the door reaches the closed position. The door can be reopened only by an operator inside the elevator who breaks the lock by moving the levers out of longitudinal alignment. Accordingly, such closures must be accessible to an operator for manual manipulation. Moreover, such closures generally are adapted to open only one door.

Examples of other door closures using lever systems are disclosed in U.S. Pat. Nos. 1,201,313; 2,723,848; 3,561,161; and 544,667.

Therefore a need exists for a closure that can automatically close either door of a pair of sliding doors, that is relatively simple, inexpensive, and easy to install, and that allows a user to open and close the door operated by the closure without manually manipulating the closure.

SUMMARY OF THE INVENTION

The present invention provides an automatic closure for either door of a pair of sliding doors. In fact, the present invention enables a user to open and automatically close simultaneously both doors of a pair of sliding doors. The closure is simple, rugged, and easy to install. The closure can be adapted easily to operate doors of any size and can be adjusted to close the doors within a range of closing rates.

The present invention includes a pivoting link having two pivoting members and biasing apparatus for the pivoting members. A first member is pivotally fixed to a first door and a second member is pivotally fixed to a second door. The members are also pivotally connected to each other. The biasing means can be fixed to either door, but preferably the innermost door, and the member attached to that door. The biasing apparatus tends to pivot the members toward a position in which the doors are closed.

Preferably, the biasing apparatus is a hydraulic cylinder of the type disclosed in U.S. Pat. No. 3,161,908 issued to Walach ("the Walach cylinder"). U.S. Pat. No. 3,161,908 is hereby incorporated by reference herein. The Walach check includes a cylinder in which a compression spring is disposed in operative relationship with a piston. The remainder of the cylinder is filled with a liquid. The piston can be partially withdrawn from the cylinder; when the piston is released, it reenters the cylinder at an adjustable rate of speed. The liquid within the cylinder prevents the piston from reentering the cylinder at an excessive rate of speed.

If the Walach cylinder is used as the biasing apparatus, the cylinder is pivotally fixed to one door and the piston is pivotally fixed to the member attached to that door. When one of the doors is opened, the piston is withdrawn partially from the cylinder. When the door is released, the compression spring pulls the piston back into the cylinder and pivots the members to move the opened door to the closed position. The liquid within the cylinder prevents the cylinder from causing the door to slam closed.

It is essential that the point of connection of the two members to each other be offset from the line passing through the points of attachment of the members to the doors when the doors are fully closed. If that line were to pass through the point of connection of the members to each other, it would be necessary for the user to apply a vertical force to that point in order to cause movement of one or the other door toward the open position. In fact, the farther that point is located from such line, the easier it is to open the doors.

It is preferable that the pivoting members of the pivoting link be bars. If such is the case, it is essential that the longitudinal axes of the bars form an angle of less than 180° when the doors are fully closed. If that angle were approximately 180°, it would be necessary for the user to exert a vertical force on the point of connection of the two bars in order to cause movement of one or the other door toward the open position. Further, it is preferable that the angle be no more than 110° when the doors are completely closed so that the door can be opened easily by the user.

The present invention is useful for allowing a user to open and automatically close either door of a pair of sliding doors. The present invention is also useful for allowing a user to open and automatically close simultaneously both doors of a pair of sliding doors.

The term "hydraulic cylinder" when used herein shall include the Walach cylinder. Also, the phrase "sliding door", when used herein, shall mean a door that is operated by moving it horizontally in a single plane.

BRIEF DESCRIPTION OF THE DRAWINGS

The following detailed description of the preferred embodiments can be understood better by referring to the accompanying drawings in which.

DETAILED DESCRIPTION OF THE PREFERRED EMBODIMENTS

Figure 2:
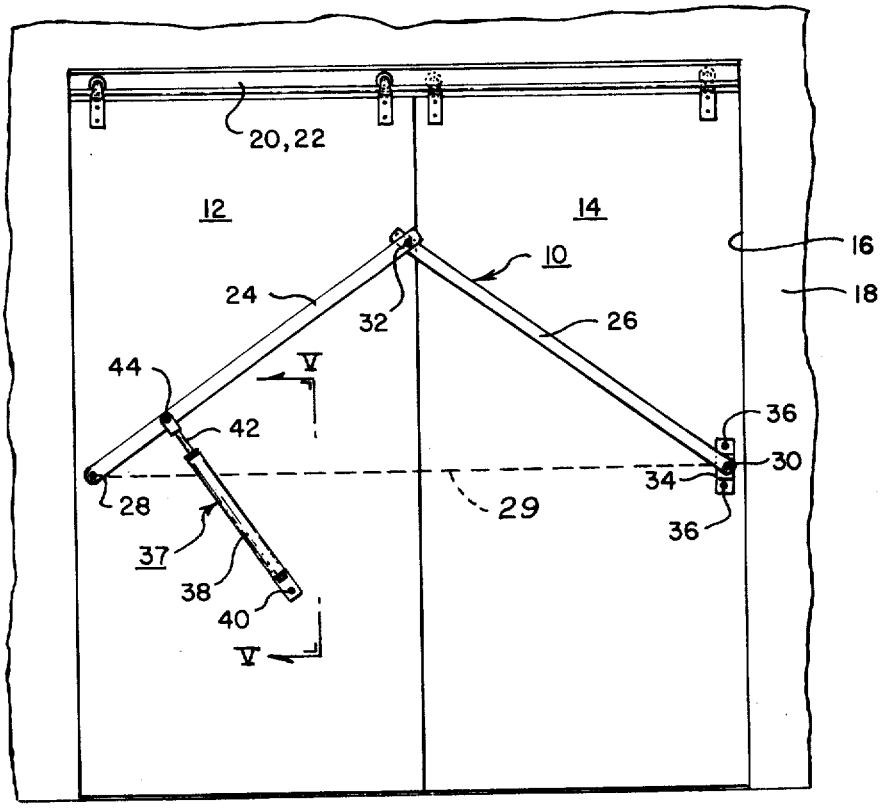
FIG. 2 is an elevational view of the closure shown in FIG. 1 with the doors closed.
Figure 3:
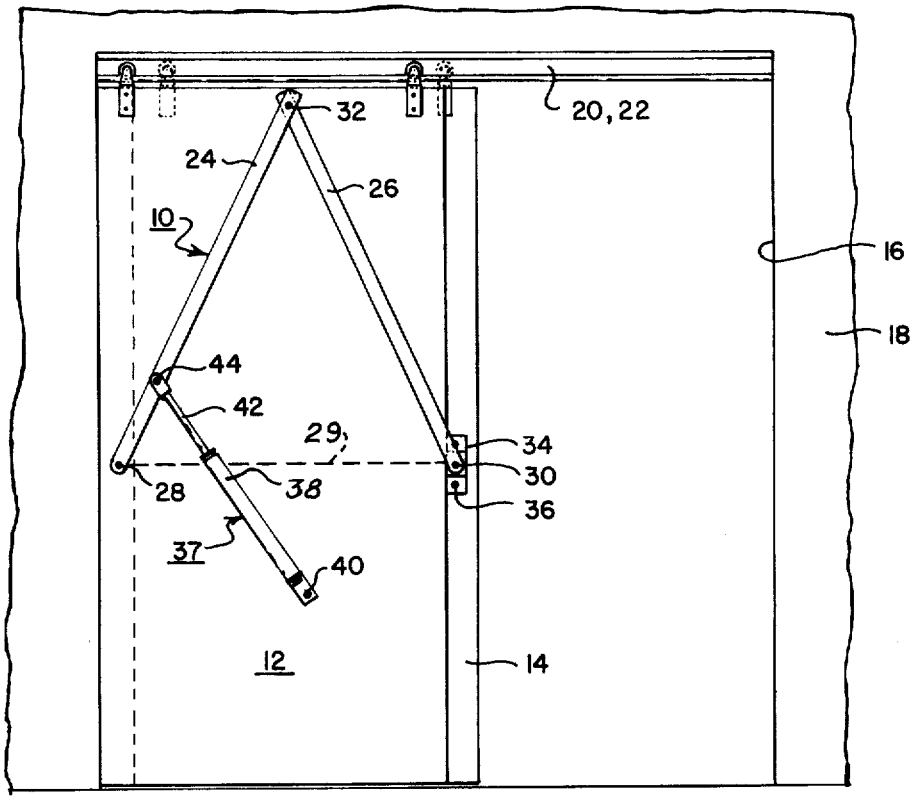
FIG. 3 is an elevational view of the closure shown in FIG. 1 with one door in the open position.
Figure 5:
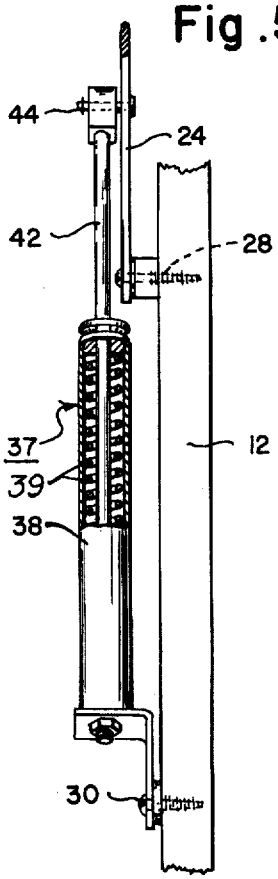
FIG. 5 is a side elevational view, partly in section, taken along the line V—V of FIG. 2.

Referring to the drawings, there is shown a sliding door closure, designated by the general reference numeral 10, embodying the present invention. Closure 10 is installed on a pair of overlapping sliding doors 12 and 14 of conventional construction, installed within opening 16 formed in wall 18. As best shown in FIGS. 2, 3 and 5, doors 12 and 14 are independently suspended from overhead tracks 20 and 22, respectively, in a conventional manner, employing rolling hangers and complementary channels. Other suitable means for mounting doors 12 and 14 in an overlapping relationship may be employed.

Figure 4:
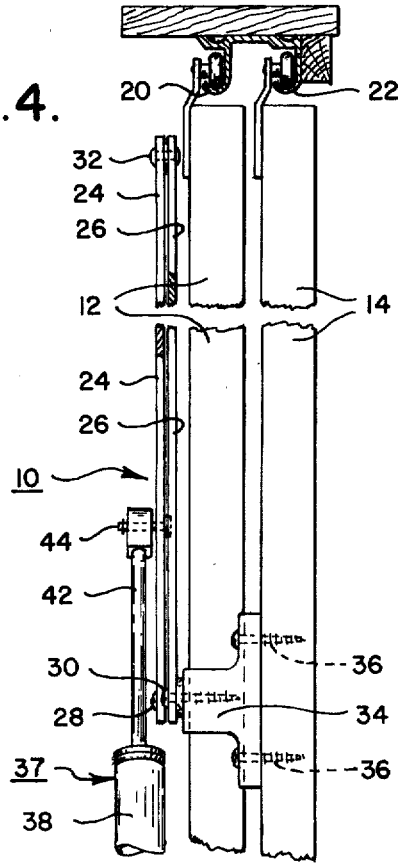
FIG. 4 is an enlarged side elevational view of the closure shown in FIG. 1.

Closure 10 includes a pair of bars 24 and 26 having their distal ends pivotally mounted to doors 12 and 14, respectively, by means of screws 28 and 30, respectively screws 28 and 30 define a connecting line 29. The adjacent ends of bars 24 and 26 are pivotally connected by means of rivet 32. Because of the overlapping relationship of doors 12 and 14, it is necessary to provide spacer block 34, mounted on door 14 by means of screws 36, to serve as the mounting point for the distal end of bar 26. In this way, bars 24 and 26 are arranged as closely as possible to being in a vertical plane parallel to the planes of doors 12 and 14, but spaced away from the innermost door 12. This relationship is best shown in FIG. 4 and assures that bars 24 and 26 are free to move without contacting door 12 and vice versa.

Figure 1:
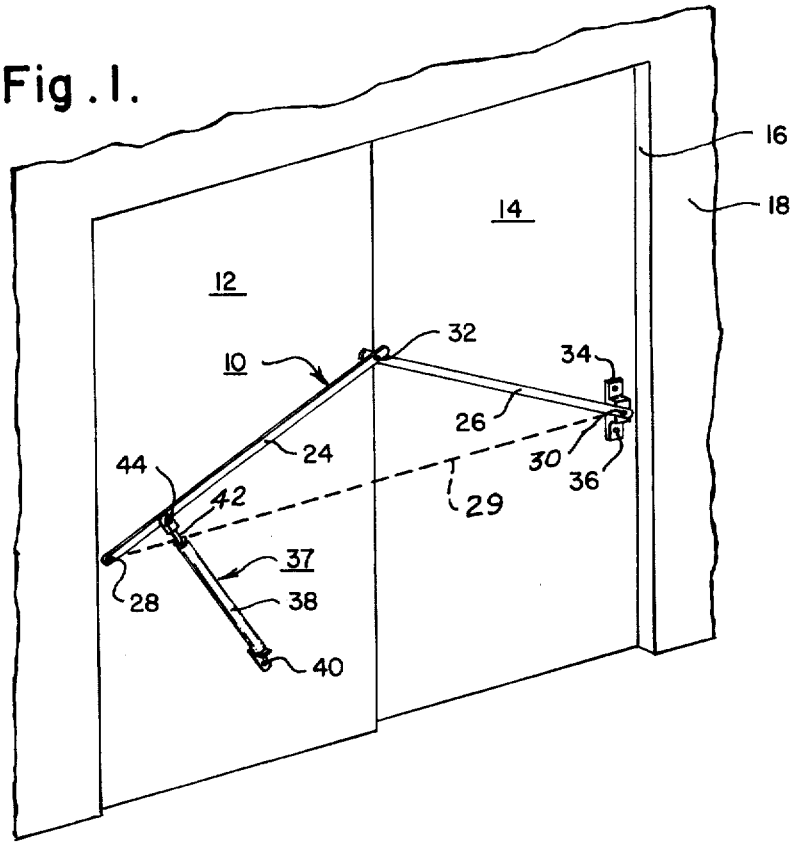
FIG. 1 is an isometric view of a closure constructed in accordance with the present invention and installed on the back sides of a pair of sliding doors.

As best shown in FIGS. 1–3, bars 24 and 26 form a pivoting link comprising an inverted "V". When either one of doors 12 or 14, or both of doors 12 and 14, are moved away from their respective jambs, the included angle of the inverted "V" formed by bars 24 and 26 decreases because their point of pivotal connection at rivet 32 is free to move upwardly in an arcuate path (see FIG. 3). Bars 24 and 26 are dimensioned and mounted on doors 12 and 14, respectively, so that when either one of doors 12 or 14 is at full travel away from its respective jamb, the pivotal connection of bars 24 and 26 at rivet 32 falls short of contact with any overhead structure (see FIG. 4). The same relationship is preserved when both of doors 12 and 14 are moved away from their jambs and toward one another.

It is an important feature of the present invention that the included angle of inverted "V" formed by bars 24 and 26 never reaches 180°. If such a relationship were permitted, bars 24 and 26 would be longitudinally aligned and would form a lock against free sliding movement of doors 12 and 14. Accordingly, it is preferred that the included angle of the "V" formed by bars 24 and 26 not exceed about 110°. In fact, the lesser the included angle, the lesser the force required to move either of doors 12 or 14 away from its jamb.

The biasing device 37 of the present invention can be any suitable mechanism, such as a compression spring, that acts upon the pivoting link formed by bars 24 and 26 to lessen the included angle of the inverted "V". Preferably, biasing device 37 is a combined compression spring and hydraulic cylinder of the type disclosed in U.S. Pat. No. 3,161,908. In the embodiment shown in the drawings, biasing device 37 includes a cylinder 38 pivotally mounted to door 12 by means of screw 40. A piston rod 42 is slidably mounted within cylinder 38 and connected thereto internally by a compression spring 39. The end of piston rod 42 that extends from cylinder 38 is pivotally connected to bar 24 through bolt 44. Cylinder 38 contains suitable hydraulic fluid to provide a damping action against movement of piston rod 42. As disclosed in U.S. Pat. No. 3,161,908, the damping rate provided by cylinder 38 is adjustable.

Cylinder 38 is mounted on door 12 and bar 24 so that when sliding doors 12 and 14 are fully closed, cylinder 38 generally is perpendicular to bar 24. When either one of doors 12 or 14 (or both doors simultaneously) is moved away from its jamb, the pivoting link formed by bars 24 and 26 moves toward its collapsed (lesser included angle) position. The upward movement of bar 24 carries with it piston rod 42 which puts the compression spring 39 within cylinder 38 under compression (see FIG. 3). When the force causing movement or holding the pivoting link is released, compression spring 39 acts to return bar 24 to its original position. The return movement of bar 24 causes the pivoting link to return to its original position and thus moves whichever one (or both) of doors 12 or 14 that is open against its jamb. The damping action of the hydraulic cylinder 38 prevents any slamming of a door against its jamb that might otherwise occur by the action of compression spring 39 within cylinder 38.

What is claimed is:

1. A closure for closing a pair of sliding doors that are adapted to overlap each other at least partially when the doors are opened comprising:

a pivoting link including a first link member pivotally mounted to a said door and a second member pivotally attached to said first link member and to the remaining said door, the point of attachment of said first member to said second member being offset from a line connecting the respective points at which said members are mounted to said doors, said point so attachment not being in alignment with said mounting points at anytime during normal operation of said closure, said closure causing said doors to close by moving at least a said door in a direction that causes said doors to overlap each other progressively less by causing said point of attachment to move toward said connecting line; and biasing means operatively connected between one said door and the said member mounted to that said one door for pivoting said point of attachment toward said connecting line to close said doors.

2. The closure claimed in claim 1 wherein said members are bars.

3. The closure claimed in claim 1 wherein said biasing means is a hydraulic cylinder.

4. The closure claimed in claim 1 wherein said biasing means is a compression spring.

5. The closure claimed in claim 2 wherein the longitudinal axes of said bars form an angle of less then 180° when both said doors are in the closed position.

6. The closure claimed in claim 5 wherein said angle is less than 110°.

7. In a closure for closing an opening, said closure being of the type having a pair of sliding doors that are adapted to be moved relative to each other to cause said closure to assume an opened position, in which said doors overlap each other at least partially, or a closed position, in which said doors overlap each other to a lesser degree than when said closure is in its opened position, the improvement of means for automatically moving said closure toward its closed position from its opened position comprising:

a pivoting link including a first link member pivotally mounted to a said door and a second member pivotally mounted to said first link member and to the remaining said door, the point of attachment of said first member to said second member being offset from a line connecting the respective points at which said members are mounted to said doors, said point of attachment not being in alignment with said mounting points at anytime during normal operation of said closure, said closure causing said doors to so move as to move said doors toward their closed position by moving said point of attachment toward said connecting line; and biasing means operatively connected between one said door and the said member mounted to said one door for pivoting said point of attachment toward said connecting line to move said doors toward their closed position.

* * * * *